US009333781B2

(12) United States Patent
Qu et al.

(10) Patent No.: US 9,333,781 B2
(45) Date of Patent: May 10, 2016

(54) PRINTER AND METHOD AND DEVICE FOR CONTROLLING SAME

(71) Applicant: Shandong New Beiyang Information Technology Co., Ltd., Shandong (CN)

(72) Inventors: Bo Qu, Shandong (CN); Xin Wang, Shandong (CN); Jinfeng Ding, Shandong (CN); Botao Wang, Shandong (CN); Xinping Wang, Shandong (CN)

(73) Assignee: Shandong New Beijang Information Technology Co., Ltd., Shandong (CN)

( * ) Notice: Subject to any disclaimer, the term of this patent is extended or adjusted under 35 U.S.C. 154(b) by 0 days.

(21) Appl. No.: 14/435,767

(22) PCT Filed: Oct. 10, 2013

(86) PCT No.: PCT/CN2013/084997
§ 371 (c)(1),
(2) Date: Apr. 15, 2015

(87) PCT Pub. No.: WO2014/059896
PCT Pub. Date: Apr. 24, 2014

(65) Prior Publication Data

US 2015/0266324 A1 Sep. 24, 2015

(30) Foreign Application Priority Data

Oct. 15, 2012 (CN) ..... 2012 1 0389788

(51) Int. Cl.

| | |
|---|---|
| ***B41J 2/165*** | (2006.01) |
| ***B41J 29/38*** | (2006.01) |
| ***B41J 2/315*** | (2006.01) |
| ***B41J 2/32*** | (2006.01) |
| ***B41J 2/35*** | (2006.01) |
| ***B41J 29/393*** | (2006.01) |
| ***B41J 2/36*** | (2006.01) |
| ***B41J 2/335*** | (2006.01) |

(52) U.S. Cl.
CPC *B41J 29/38* (2013.01); *B41J 2/315* (2013.01); *B41J 2/32* (2013.01); *B41J 2/335* (2013.01); *B41J 2/35* (2013.01); *B41J 2/36* (2013.01); *B41J 29/393* (2013.01)

(58) Field of Classification Search
None
See application file for complete search history.

(56) References Cited

U.S. PATENT DOCUMENTS 5,841,464 A * 11/1998 Phillips ..... B41J 2/48 347/225
2011/0181677 A1* 7/2011 Imaizumi ..... B41J 2/0451 347/192

FOREIGN PATENT DOCUMENTS

| | | | |
|---|---|---|---|
| CN | 101267694 | A | 9/2008 |
| CN | 101879817 | A | 11/2010 |
| CN | 102693105 | A | 9/2012 |
| DE | 4244259 | A1 | 7/1994 |
| JP | 2006326908 | A | 12/2006 |
| TW | 200720096 | | 6/2007 |

* cited by examiner

*Primary Examiner* — Alejandro Valencia
(74) *Attorney, Agent, or Firm* — Fraser Clemens Martin & Miller LLC; James D. Miller

(57) ABSTRACT

The disclosure discloses a printer and a method and device for controlling the same. The method for controlling the printer comprises: detecting the number of heating units of a currently mounted printing head; acquiring a resolution, corresponding to the detected number of the heating units, of the printing head; and setting a printer parameter according to the acquired resolution of the printing head. The problem of high error rate after the resolution of the printing head of the printer is changed is solved.

9 Claims, 9 Drawing Sheets

| Resolution of the printing head(dpi) | Number of the heating units | Vertical printing resolution (dpi) | Printing speed (millimeter /second) | Width of the printing buffer (bit) | Height of the printing buffer(bit) |
|---|---|---|---|---|---|
| 203 | 640 | 203 | 300 | 640 | 30 |
| 300 | 945 | 300 | 200 | 945 | 20 |
| 600 | 1890 | 600 | 100 | 1890 | 10 |

| | (j+1) th bit | Jth bit | (j-1)th bit | ... | Second bit | First bit |
|---|---|---|---|---|---|---|
| D1 → | 1 | 0 | 0 | ... | 0 | 0 |
| D2 → | 0 | 1 | 0 | ... | 0 | 0 |
| D3 → | 0 | 0 | 1 | ... | 0 | 0 |
| ⋮ | | | | ⋮ | | |
| Dj → | 0 | 0 | 0 | ... | 1 | 0 |
| D(j+1) → | 0 | 0 | 0 | ... | 0 | 1 |

(j+1) bits

PRINTER AND METHOD AND DEVICE FOR CONTROLLING SAME

This invention patent application was submitted to the State Intellectual Property Office on Oct. 15, 2012 with the application number of 201210389788.0, named after "printer and method and device for controlling the same", and all its contents are combined here as reference.

TECHNICAL FIELD OF THE INVENTION

The disclosure relates to the field of printer, in particular to a printer and a method and device for controlling the same.

BACKGROUND OF THE INVENTION

At present, a thermal printer is applied more and more widely, multiple heating units arranged in a row at an equal interval along a width direction (hereinafter referred to as horizontal) of a printing head are arranged on the printing head of the thermal printer, and every time when a printing medium is driven to move by a minimum unit length (i.e. one dot line) relative to the printing head along a direction (hereinafter referred to as vertical) perpendicular to the width direction of the printing head, the heating units are powered on to be heated to form printing dots corresponding to the heated heating units on the thermo-sensitive heating medium in contact with the printing head, thereby finishing printing a dot line image on the printing medium.

A printing resolution is an important index for measuring printing quality of the thermal printer, refers to maximum printable dots on a unit length of the printing medium during printing output, and is usually represented by Dots Per Inch (DPI). The printing resolution includes a horizontal printing resolution and a vertical printing resolution, wherein the horizontal printing resolution refers to maximum printable dots on a horizontal unit length of the printing medium during printing output, and is determined by an arrangement density (hereinafter referred as a resolution of the printing head) of the heating units of the printing head because the heating units of the printing head correspond to horizontal printing dots of the printing medium one to one; and the vertical printing resolution refers to maximum printable dots on a vertical unit length of the printing medium, i.e. the number of printing execution times of the printing head during the movement of the printing medium by the unit length, and is obviously determined by the movement length of the printing medium relative to the printing head during each printing of the printing head.

Above all, the horizontal printing resolution of the thermal printer is determined by the resolution of the printing head arranged on the thermal printer, and for example, a horizontal printing resolution of a printer provided with a printing head with a resolution of 203 dpi is 203 dpi. However, along with a change in an application condition, a user may need to regulate the horizontal printing resolution when using the printer, for example, when the user has a higher requirement on the printing quality, a higher horizontal printing resolution for printing is required, so that the printer is provided with a printing head with a higher resolution, such as a printing head with a resolution of 300 dpi or 600 dpi; while when the user has a lower requirement on the printing quality, a lower horizontal printing resolution for printing is required to increase a printing speed, so that the printer is provided with a printing head with a lower resolution, such as a printing head with a resolution of 203 dpi. In order to ensure the printing quality and the normal work of the printing head, a printer parameter related to the horizontal printing resolution is also required to be regulated after the horizontal printing resolution of the printer is regulated. For example, in order to keep an aspect ratio of a printed image or character unchanged, the vertical printing resolution is also required to be regulated according to the same ratio when the horizontal printing resolution is changed, and for another example, a data length of dot matrix data transmitted to the printing head is also required to be regulated according to the number of the heating units of the printing head every time when the dot line image is printed after the horizontal printing resolution is regulated. Therefore, after the resolution of the printing head of the printer is changed, that is, the horizontal printing resolution of the printer is changed, the printer is required to identify the resolution of the currently mounted printing head and regulate the printer parameter related to the horizontal printing resolution according to the resolution of the printing head.

A method for identifying the resolution of the printing head of the printer is disclosed in a related art, and according to the method, a Double In-line Package (DIP) switch for representing the resolution of the printing head is arranged on a control circuit board of the printer, and the printer determines the resolution of the printing head by detecting a state of the DIP switch, so that the horizontal printing resolution of the printer is determined, and the printer parameter related to the horizontal printing resolution is set.

According to the method for identifying the resolution of the printing head of the printer in the related art, after the resolution of the printing head of the printer is changed, the user needs to manually change the DIP switch on the control circuit board into a state corresponding to the resolution of the printing head, and such manual changing brings inconvenience to operation of the user, and easily causes an error; and when the user manually changes the DIP switch to cause the error, the resolution, detected by the printer, of the printing head is wrong, and a parameter setting error is further caused when the printer parameter related to the horizontal printing resolution is regulated, which may cause anomaly of a printed content of the printer as well as damage to the printing head.

For the problem of high error rate after the resolution of the printing head of the printer is changed in the prior art, there is yet no effective solution.

SUMMARY OF THE INVENTION

A main purpose of the disclosure is to provide a printer and a method and device for controlling the same, so as to solve the problem of high error rate after a resolution of a printing head of the printer is changed in the prior art.

In order to achieve the purpose, according to one aspect of the disclosure, a method for controlling a printer is provided. The method for controlling the printer comprises: detecting the number of heating units of a currently mounted printing head; acquiring a resolution, corresponding to the detected number of the heating units, of the printing head; and setting a printer parameter according to the acquired resolution of the printing head.

Furthermore, the step of acquiring the resolution, corresponding to the number of the heating units, of the printing head comprises: acquiring the resolution, corresponding to the detected number of the heating units, of the printing head according to a pre-stored corresponding relationship between the number of the heating units and the resolution of the printing head, or calculating the resolution, corresponding to the detected number of the heating units, of the printing head according to the detected number of the heating units and an effective printing width.

Furthermore, before the step of setting the printer parameter according to the acquired resolution of the printing head, the method further comprises: detecting a resistance value of each heating unit of the printing head; and calculating an average resistance value of all the heating units of the printing head. The step of setting the printer parameter according to the acquired resolution of the printing head comprises: setting the printer parameter according to the resolution of the printing head and the average resistance value.

Furthermore, the step of setting the printer parameter according to the resolution of the printing head and the average resistance value comprises: judging whether the average resistance value is equal to a preset resistance value of the heating units or not, and setting printing strobe time according to the average resistance value when the average resistance value is determined to be unequal to the preset resistance value of the heating units.

Furthermore, before the step of setting the printer parameter according to the acquired resolution of the printing head, the method further comprises: judging whether the resolution of the currently mounted printing head is equal to a preset resolution of the printing head or not, and setting the printer parameter according to the acquired resolution of the printing head when the resolution of the currently mounted printing head is determined to be unequal to the preset resolution of the printing head.

Furthermore, the step of detecting the number of the heating units of the currently mounted printing head comprises: controlling a test power supply to supply power to the printing head to make a test voltage $V_t$ act on a reference resistance Rref and the heating units, wherein the reference resistance Rref is configured to divide the test voltage $V_t$; generating test data Di, wherein i is a positive integer between 1 and j+1, an initial value of i is 1, j is the number of the heating units of the printing head with a maximum resolution supported by the printer, the test data Di consists of j+1-bit binary data, a value of the (j+2−i)th bit of the test data Di is "1", and values of the other bits are all "0"; transmitting the test data Di to the printing head, and transmitting an effective latch signal and an effective strobe signal of the printing head, wherein a shift register of a printing head driver of the printing head sequentially receives and stores the bits of the test data Di under the synchronization of a clock signal CLK; calculating a detection voltage $V_i$ output by a voltage detection circuit according to $V_i=V_t*(Rhd/(Rref+Rhd))$, wherein Rhd is the resistance value of heating units of the printing head, and Rref is a resistance value of the reference resistance of the voltage detection circuit; judging whether a difference between the test voltage $V_t$ and the detection voltage $V_t$ is greater than a preset threshold value or not, adding 1 to a value of i when the difference between the test voltage $V_t$ and the detection voltage $V_t$ is greater than the preset threshold value, and continuing transmitting the test data Di to the printing head; and when the difference between the test voltage $V_t$ and the detection voltage $V_i$ is determined not to be greater than the preset threshold value, determining the number of the heating units of the printing head to be N=i−1.

Furthermore, when the difference between the test voltage $V_t$ and the detection voltage $V_i$ is determined to be greater than the first preset threshold value, the method further comprises: calculating and storing the resistance value Ri of the heating units of the printing head in a power-on state, wherein an average value of the resistance value Ri of all the heating units of the printing head is used as the average resistance value of the heating units of the printing head.

In order to achieve the purpose, according to another aspect of the disclosure, a device for controlling a printer is provided. The device for controlling the printer comprises: a detection unit, configured to detect the number of heating units of a currently mounted printing head; an acquisition unit, configured to acquire a resolution, corresponding to the detected number of the heating units of the printing head, of the printing head; and a setting unit, configured to set a printer parameter according to the acquired resolution of the printing head.

Furthermore, the acquisition unit comprises: an acquisition module, configured to acquire the resolution, corresponding to the detected number of the heating units of the printing head, of the printing head according to a pre-stored corresponding relationship between the number of the heating units of the printing head and the resolution of the printing head, or a calculation module, configured to calculate the resolution, corresponding to the detected number of the heating units of the printing head, of the printing head according to the detected number of the heating units of the printing head and an effective printing width.

Furthermore, the detection unit is further configured to detect a resistance value of each heating unit, and the device further comprises: a calculation unit, configured to calculate an average resistance value of all the heating units of the currently mounted printing head, wherein the setting unit is configured to set the printer parameter according to the resolution of the printing head and the average resistance value.

In order to achieve the purpose, according to another aspect of the disclosure, a printer is provided, which comprises: a printing head, configured to form a printed image on a printing medium, wherein the printing head comprises multiple heating units which are arranged in a row at an equal interval along a width direction of the printing head; a printing head power supply, configured to provide a voltage required by the work and test of the printing head; a printing head driver, configured to receive a control signal and dot matrix data, and sequentially transmit the dot matrix data to the heating units of the printing head under the control of the control signal; a heating unit detector, configured to detect the number of the heating units of the currently mounted printing head; and a controller, configured to acquire a resolution, corresponding to the detected number of the heating units, of the printing head, and set a printer parameter according to the acquired resolution of the printing head.

According to the method or device for controlling the printer, the resolution of the printing head of the printer can be automatically and accurately detected, so that an error, caused by misoperation of a user, of the detected resolution of the printing head of the printer is prevented, and the problem of high error rate after the resolution of the printing head of the printer is changed in the prior art is solved.

BRIEF DESCRIPTION OF THE DRAWINGS

The drawings forming a part of the disclosure is adopted to provide further understanding of the disclosure, and the schematic embodiments and description of the disclosure are adopted to explain the disclosure, and do not form improper limits to the disclosure. In the drawings.

DETAILED DESCRIPTION OF THE EMBODIMENTS

It should be noted that the embodiments of the invention and the characteristics in the embodiments can be combined under the condition of no conflicts. The invention is described below with reference to the drawings and the embodiments in detail.

Figure 1:
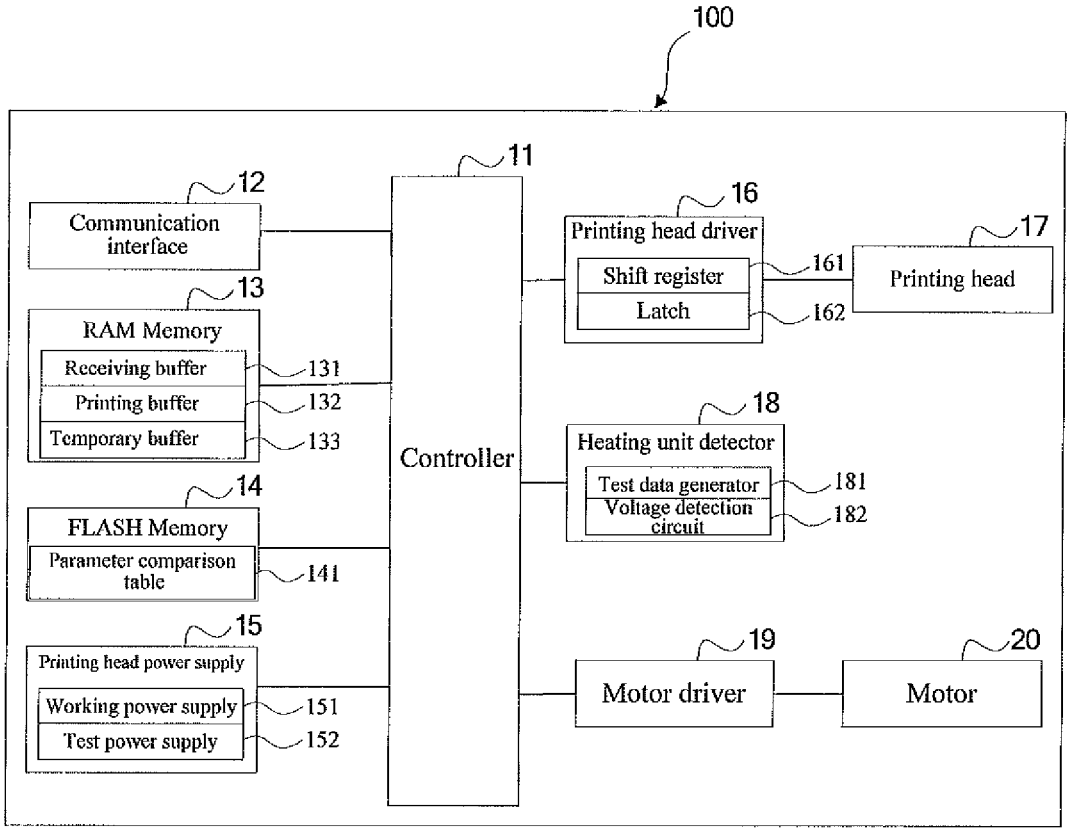
FIG. 1 is a structure diagram of a printer according to a first embodiment of the disclosure.

FIG. 1 is a structure diagram of a printer according to a first embodiment of the disclosure, and as shown in FIG. 1, the printer 100 includes a controller 11, a communication interface 12, a Random Access Memory (RAM) 13, a FLASH memory 14, a printing heating power supply 15, a printing head driver 16, a printing head 17, a heating unit detector 18, a motor driver 19 and a motor 20.

The controller 11 is configured to control each module to execute work, and for example, the controller 11 controls the communication interface 12 to execute data transmission between the printer 100 and a printing request device (such as a computer or network equipment); the controller 11 processes received printing data, and generates dot matrix data to be transmitted to the printing head 17; the controller 11 outputs a control signal for the printing head 17; and the controller 11 controls the motor driver 19 to drive an output shaft of the motor 20 to rotate to drive a printing medium to move in a medium passage.

The communication interface 12 is configured to execute data transmission between the printer 100 and the printing request device (such as the computer or the network equipment), and for example, the communication interface 12 receives a printing control command or printing data from the printing request device, and transmits a resolution of the printing head of the printer 100 to the printing request device.

The RAM 13 includes a receiving buffer 131, a printing buffer 132 and a temporary buffer 133. Wherein, the receiving buffer 131 is configured to store the printing control command and the printing data, which are received by the communication interface 12; the printing buffer 132 is configured to store the dot matrix data to be transmitted to the printing head; and the temporary buffer 133 is configured to store data and a variable, which are generated in a program running process, such as test data Di generated by the heating unit detector 18, a detection voltage $V_i$, detected by the heating unit detector 18, at a test point, the number N of heating units and a resistance value Ri of each heating unit.

Figures 7, 8:
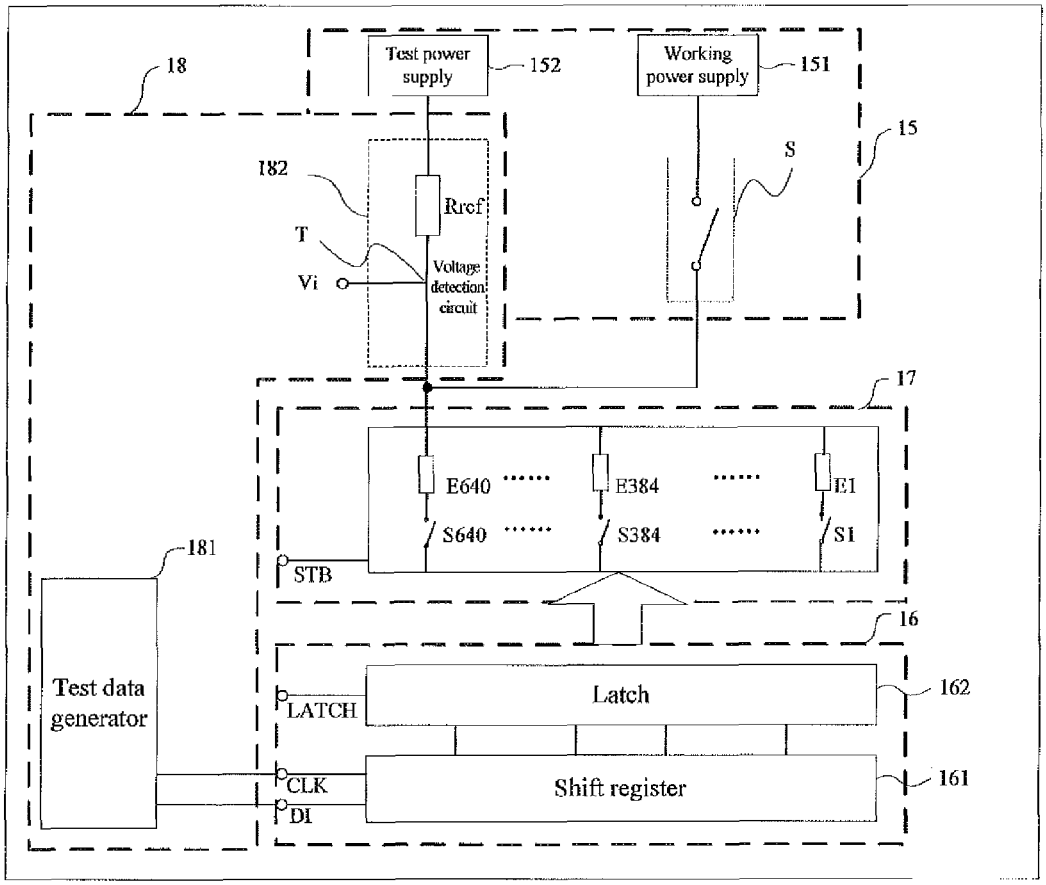
FIG. 7 is a diagram of a printing head and a detection circuit thereof according to an embodiment of the disclosure.
FIG. 8 is a diagram of a parameter comparison table of a printer according to an embodiment of the disclosure.

The FLASH memory 14 is configured to store a control program of the printer, and meanwhile, the FLASH memory 14 is further configured to store a preset resolution $Res_0$ of the printing head, a preset resistance value $R_0$ of the heating units, an effective printing width W, a first preset threshold value, a maxim value j of the number of the heating units, a parameter comparison table 141 and the like. Wherein, the preset resolution $Res_0$ of the printing head is the resolution, which is acquired during the last heating unit detection of the printing head, of the printing head; the preset resistance value $R_0$ of the heating unit is an average resistance value, which is calculated during the last heating unit detection of the printing head, of all the heating units of the printing head; the effective printing width W is determined by a width of the mounted printing head, and after a structural design of the printer 100 is determined, the width of the printing head which can be mounted on the printer is a fixed value, so that the effective printing width W is a fixed value, and the controller 11 can calculate the resolution of the printing head 17 of the printer 100 according to the number N of the heating units, which is detected by the heating unit detector 18, and the effective printing width W; the first preset threshold value is configured to judge a relationship between the detection voltage $V_i$, detected by the heating unit detector 18, at the test point and a test voltage $V_t$ provided by the printing head power supply 15, and the controller 11 determines that one heating unit of the printing head is in a power-on state when a value of $(V_t-V_i)$ is greater than the first preset threshold value, and determines that no heating units of the printing head are in the power-on state when the value of $(V_t-V_i)$ is not greater than the first preset threshold value; the maximum value j of the number of the heating units is the number of the heating units of the printing head with a maximum resolution supported by the printer, and for example, if the effective printing width W of the printing head which can be mounted on the printer is 80 millimeters and the maximum resolution Pmax, supported by the printer, of the printing head is 600 dpi, the number j of the heating units of the printing head with the maximum resolution supported by the printer is (80/25.4)*600=1,890; and the parameter comparison table 141 is configured to store resolutions of various printing heads supported by the printer 100 and corresponding printer parameters, such as a vertical printing resolution and a data length (i.e. a width of the printing buffer) of the dot matrix data transmitted to the printing head during the printing of each dot line image, and when the printing head 17 of the printer 100 is changed, the controller 11 detects the resolution of the currently mounted printing head 17, acquires the parameter corresponding to the resolution of the printing head by querying the parameter comparison table 141, and sets the printer parameter according to the acquired parameter. FIG. 8 is a diagram of a parameter comparison table of a printer according to an embodiment of the disclosure, and as shown in FIG. 8, the parameter comparison table totally stores three resolutions of printing heads and corresponding printer parameters, wherein the three resolutions of the printing heads are 203 dpi, 300 dpi and 600 dpi respectively; for each resolution of the printing heads, the printer parameters related to the resolution of the printing heads include the number of the heating units, the vertical printing resolution, a printing speed, the width of the printing buffer, a height of the printing buffer and the like; and for example, the number of the heating units of the printing head with the resolution 203 dpi is 640, and when the printing head with such a resolution is mounted, the vertical printing resolution of the printer is 203 dpi, the printing speed is 300 millimeters/second, the width of the printing buffer is 640 bits, and the height of the printing buffer is 30 bits.

The printing head power supply 15 is configured to provide a voltage required by the work and test of the printing head 17, and the printing head power supply 15 includes a working power supply 151 and a test power supply 152, wherein the working power supply 151 provides a working voltage $V_0$, for example, 24V, required by the printing head 17 during the execution of printing work; and the test power supply 152 provides the test voltage $V_t$, 3.3V, for example, required by the printing head 17 during the heating unit detection of the printing head. FIG. 7 is a diagram of a printing head and a detection circuit thereof according to an embodiment of the disclosure, and as shown in FIG. 7, the working power supply 151 is controlled by a switch S, the switch S is connected with an output signal (not shown in FIG. 7) of the controller 11, and can be in an on or off state according to the output signal of the controller 11, the working voltage $V_0$ provided by the working power supply acts on the printing head when the switch S is in the on state, and the test voltage $V_t$ provided by the test power supply 152 acts on the printing head when the switch S is in the off state.

The printing head driver 16 is configured to receive the control signal output by the controller 11 and the dot matrix data transmitted by the printing buffer 132, and sequentially transmit the dot matrix data to the heating units of the printing head 17 under the control of the control signal, wherein the printing head driver 16 includes a shift register 161 and a latch 162. As shown in FIG. 7, the shift register 161 sequentially receives bits of the dot matrix data from the printing buffer 132 through a data signal DI under the synchronization of a clock signal CLK output by the controller 11, and the bits of the dot matrix data area stored in the shift register 161, wherein a storage width of the shift register 161 is M, that is, maximum bits can be stored in the shift register 161 is M, a value of M is equal to the number of the heating units of the printing head 17, each bit stored corresponds to a heating unit, and when the number of the received bits exceeds the storage width M of the shift register 161, the previously received bits are removed from the shift register 161, that is, only the last M bits are reserved in the shift register 161; and the latch 162 latches the bits stored in the shift register 161 in the corresponding heating units of the printing head 17 when a latch signal LATCH output by the controller 11 is effective.

The printing head 17 is configured to form a printed image on the printing medium.

Wherein, the printing head 17 includes multiple heating units which are arranged in a row at an equal interval along a width direction of the printing head, and for example, the printing head 17, as shown in FIG. 7, includes totally 640 heating units E1, . . . , E384, . . . , E640, wherein each heating unit has a certain resistance value, and a rated resistance value of each heating unit is equal. When the power voltage provided by the printing head power supply 15 acts on the heating units, the heating units are in power-on or power-off state under the action of a strobe signal STB provided by the controller 11 and the bits transmitted by the shift register 161. As shown in FIG. 7, when the strobe signal STB provided by the controller 11 is changed from an ineffective state (such as high level) into an effective state (such as low level), if the bit, corresponding to the xth heating unit, transmitted by the shift register 161 is an effective value (such as binary "1"), a switch Sx corresponding to the xth heating unit is in an on state, the xth heating unit is in a power-on state, and if the voltage provided for the printing head 17 by the printing head power supply 15 is the working voltage $V_0$, the xth heating unit is heated while being powered on to form a printed dot on the printing medium; and when the strobe signal STB provided by the controller 11 is in an ineffective state (such as high level) or the binary bit transmitted by the shift register is an ineffective value (such as binary "0"), the switch Sx is in an off state, and the xth heating unit is in a power-off state. Therefore, when the printing head power supply 15 provides the working voltage for the printing head 17, the multiple heating units of the printing head 17 are controlled to be heated or not to be heated according to the control signal transmitted by the controller 11 and the bits transmitted by the shift register 161, thereby forming a set image or character on the printing medium.

The heating unit detector 18 is configured to detect the number of the heating units of the printing head 17, and the heating unit detector 18 includes a test data generator 181 and a voltage detection circuit 182, wherein the test data generator 181 is configured to generate the test data for heating each heating unit; the voltage detection circuit 182, as shown in FIG. 7, is configured to divide the test voltage $V_t$ provided by the test power supply 152 to make a part of the test voltage $V_t$ act on reference resistance Rref and the other part of the test voltage $V_t$ act on the heating units of the printing head 17, and simultaneously outputs the voltage $V_i$ (called detection voltage for short) acting on the heating units of the printing head 17 according to the test data generated by the test data generator 181, and the controller 11 processes the detection voltage $V_i$ output by the voltage detection circuit 182, judges the number of the heating units of the printing head 17 according to the relationship between the detection voltage $V_i$ and the test voltage $V_t$ provided by the test power supply 152, and calculates the resistance value $R_i$ of the heating units in the power-on state according to the value of $V_i$.

The motor driver 19 is configured to output current required by the rotation of the output shaft of the motor 20 according to a pulse control signal provided by the controller 11.

The motor 20 is configured to drive the printing medium to move in the medium passage.

Figure 2A:
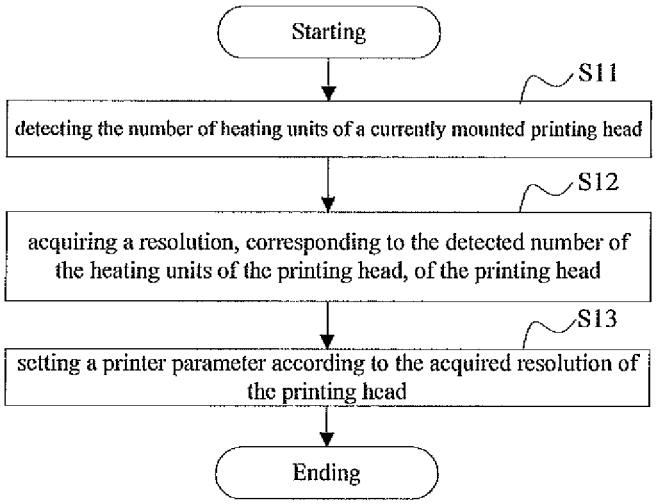
FIG. 2*a* is a flowchart of a method for controlling a printer according to an embodiment of the disclosure.

FIG. 2*a* is a flowchart of a method for controlling a printer according to an embodiment of the disclosure, the printer mentioned in the embodiment may be the printer in the embodiment shown in FIG. 1, and the method includes the following steps:

Step 11: detecting the number of heating units of a currently mounted printing head;

Step 12: acquiring a resolution, corresponding to the detected number of the heating units of the printing head, of the printing head, wherein when the resolution, corresponding to the detected number of the heating units of the printing head is acquired, the following manners can be adopted:

Manner 1:

The resolution, corresponding to the detected number of the heating units of the printing head, of the printing head is acquired according to a pre-stored corresponding relationship between the number of the heating units of the printing head and the resolution of the printing head, that is, the corresponding relationship between resolutions of different printing heads and the numbers of the heating units of the printing heads can be pre-stored in the printer, and then the resolution of the currently mounted printing head is determined by virtue of the corresponding relationship and the detected number of the heating units of the printing head;

or,

Manner 2:

The resolution, corresponding to the detected number of the heating units of the printing head, of the printing head is calculated according to the detected number of the heating units of the printing head and an effective printing width, that is, the resolution of the currently mounted printing head is calculated; and Step 13: setting a printer parameter according to the acquired resolution of the printing head.

In the method for controlling the printer, the resolution of the printing head can be automatically and accurately detected, and the related printer parameter can be set, so that an error, caused by misoperation of a user, of the detected resolution of the printing head of the printer is prevented, and the problem of high error rate after the resolution of the printing head of the printer is changed in the prior art is solved.

Figure 2B:
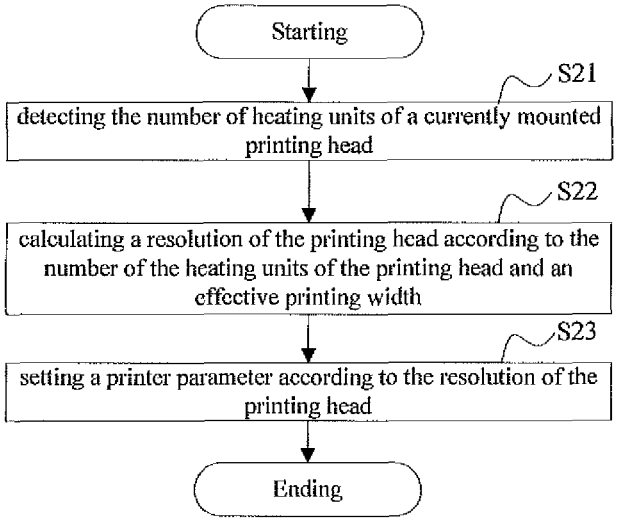
FIG. 2*b* is a flowchart of a method for controlling a printer according to a first preferred embodiment of the disclosure.

FIG. 2*b* is a flowchart of a method for controlling a printer according to a first preferred embodiment of the disclosure, and the method includes the following steps:

Step 21: detecting the number of heating units of a currently mounted printing head.

When the printer is powered on or receives a control command for detecting a resolution of the printing head, a controller controls a heating unit detector to detect the number of the heating units of the currently mounted printing head, and stores the detected number N of the heating units of the printing head in a temporary buffer of a RAM.

Step 22: calculating the resolution of the printing head according to the number of the heating units of the printing head and an effective printing width.

The controller calculates the resolution P (the unit is dpi) of the printing head according to the number N, which is stored in the RAM, of the heating units of the printing head and the effective printing width W (the unit is millimeter) stored in a FLASH memory, wherein P=M/(W/25.4), and for example, if the number N of the heating units of the printing head is known to be 640 and the effective printing width W is known to be 80 millimeters, the resolution of the printing head is P=640/(80/25.4)=203 dpi.

Step 23: setting a printer parameter according to the resolution of the printing head.

The controller searches a parameter comparison table stored in the FLASH memory to acquire a parameter, such as a vertical printing resolution and a width of a printing buffer, corresponding to the resolution of the printing head according to the resolution, which is calculated in Step 22, of the printing head, and sets the printer parameter according to the acquired parameter.

Figure 3:
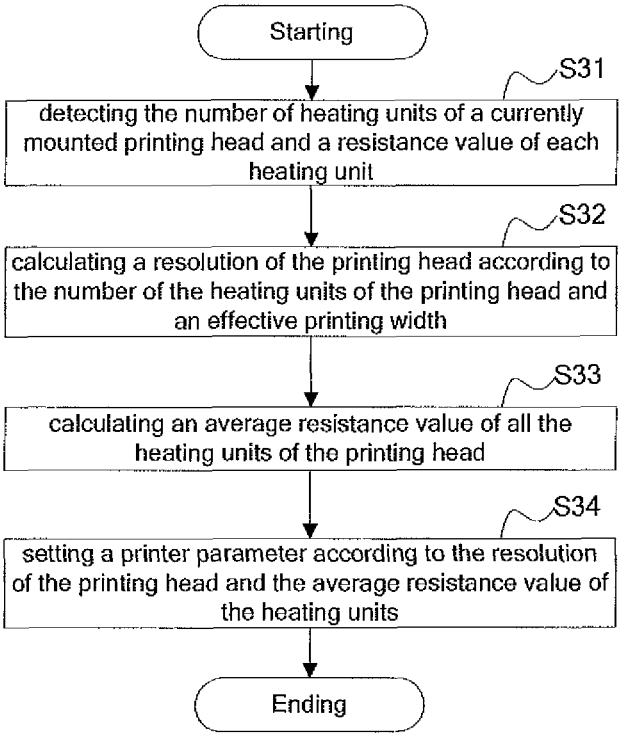
FIG. 3 is a flowchart of a method for controlling a printer according to a second preferred embodiment of the disclosure.

FIG. 3 is a flowchart of a method for controlling a printer according to a second preferred embodiment of the disclosure, and the method includes the following steps:

Step 31: detecting the number of heating units of a currently mounted printing head and a resistance value of each heating unit.

A controller controls a heating unit detector to detect the number of the heating units of the currently mounted printing head and the resistance value of each heating unit, and stores the detected number N of the heating units of the printing head and the detected resistance value $R_i$ (i is a positive integer, and is more than or equal to 1 and less than or equal to N) of each heating unit in a temporary buffer of a RAM.

Step 32: executing operation the same as that in Step 22.

Step 33: calculating an average resistance value of all the heating units of the printing head.

The controller calculates the average resistance value of all the heating units according to the resistance value $R_i$ (i is a positive integer, and is more than or equal to 1 and less than or equal to N), stored in the RAM, of each heating unit, wherein the number of the heating units of the printing head is N and the resistance value of each heating unit is $R_i$, so that the average resistance value Raw of all the heating units is $(R_1+R_2+\ldots+R_N)/N$.

For a printing head, the resistance value of each heating unit of the printing head is theoretically equal, and is a rated resistance value, but in fact, there exists an error of a certain range, +/−3 percent, for example, between the resistance value of each heating unit and the rated resistance value; and with the existence of the error of a certain range between the resistance value of each heating unit of the printing head and the rated resistance value, it is more accurate to take the average resistance value Ravr of all the heating units as the resistance value of each heating unit of the prin Step 34: setting a printer parameter according to a resolution of the printing head and the average resistance value of the heating units.

The controller searches a parameter comparison table stored in a FLASH memory to acquire a parameter, such as a vertical printing resolution and a width of a printing buffer, corresponding to the resolution of the printing head according to the resolution, which is calculated in Step 32, of the printing head, and sets the printer parameter according to the acquired parameter. Meanwhile, the controller calculates the power-on time, i.e. printing strobe time, of each heating unit during the printing of the printer according to the average resistance value, which is calculated in Step 33, of the heating units at a certain rule, and sets the printing strobe time according to a calculation result.

In a flow of the method in the embodiment, the printer detects the resistance value of each heating unit, calculates the average resistance value of all the heating units according to the resistance value of each heating unit, and sets the printing strobe time according to the average resistance value of the heating units, so that a printing effect after the printing head of the printer is replaced can be kept consistent with that before the printing head is replaced if the resistance value of the heating units of the printing head are changed after the printing head of the printer is replaced, and for example, a printing density of a printed image after the printing head of the printer is replaced is kept consistent with that before the printing head is replaced; and meanwhile, the printing strobe time is regulated according to the average resistance value of the heating units, so that the printing head is favourably protected, and the service life of the printing head is prolonged.

Figure 4:
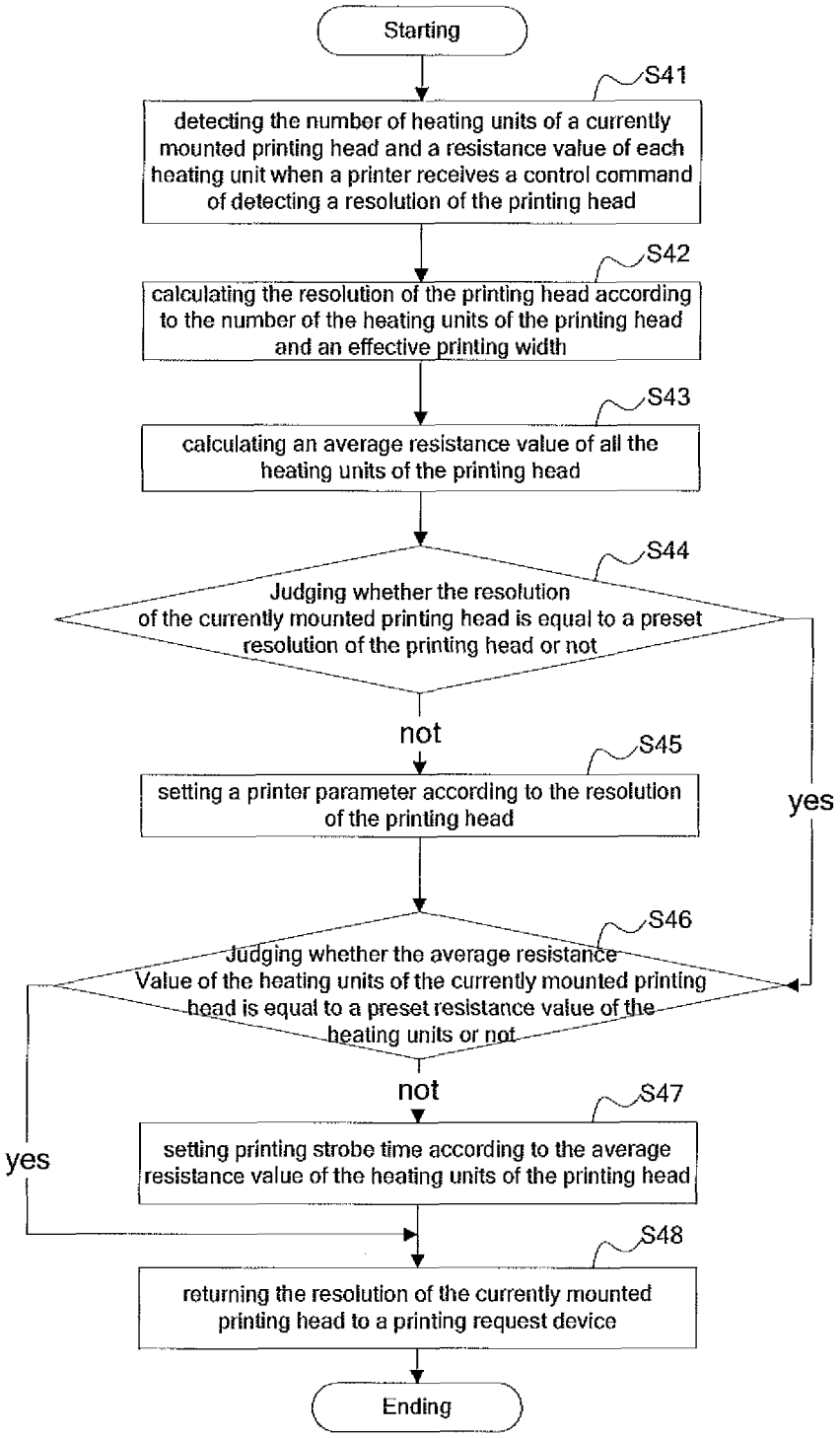
FIG. 4 is a flowchart of a method for controlling a printer according to a third preferred embodiment of the disclosure.

FIG. 4 is a flowchart of a method for controlling a printer according to a third preferred embodiment of the disclosure, the printer executes a flow of the method when receiving a control command of detecting a resolution of a printing head from a printing request device, and the method includes the following steps:

Step 41: detecting the number of heating units of a currently mounted printing head and a resistance value of each heating unit after the printer receives the control command of detecting the resolution of the printing head.

Step 42 to Step 43: executing operation the same as that in Step 32 to Step 33.

Step 44: judging whether a resolution of the currently mounted printing head is equal to a preset resolution of the printing head or not.

A controller judges whether the resolution, which is calculated in Step 42, of the currently mounted printing head is equal to the preset resolution $Res_0$, which is stored in a FLASH memory, of the printing head or not, and if the resolution of the currently mounted printing head is equal to the preset resolution $Res_0$, it is determined that the resolution of the currently mounted printing head of the printer is kept unchanged compared with a resolution of a printing head (hereinafter referred to as a previous printing head) of the printer during the last resolution detection of the printing head, and Step 46 is executed, otherwise Step 45 is executed.

Step 45: setting a printer parameter according to the resolution of the printing head.

When the resolution of the currently mounted printing head of the printer is unequal to the preset resolution $Res_0$, which is stored in the FLASH memory, of the printing head, it is determined that the resolution of the currently mounted printing head of the printer is changed compared with the resolution of the previous printing head, and the controller stores the resolution of the currently mounted printing head in the FLASH memory as the preset resolution of the printing head, simultaneously searches a parameter comparison table stored in the FLASH memory to acquire a parameter, such as a vertical printing resolution and a width of a printing buffer, corresponding to the resolution of the printing head, and sets the printer parameter according to the acquired parameter.

Step 46: judging whether an average resistance value of the heating units of the currently mounted printing head is equal to a preset resistance value of the heating unit or not.

The controller judges whether the average resistance value, which is calculated in Step 43, of the heating units of the currently mounted printing head of the printer is equal to the preset resistance value $R_0$, which is stored in the FLASH memory, of the heating units or not, and if the average resistance value, which is calculated in Step 43, of the heating units of the currently mounted printing head of the printer is equal to the preset resistance value $R_0$, which is stored in the FLASH memory, of the heating units, it is determined that the average resistance value of the heating units of the currently mounted printing head is kept unchanged compared with an average resistance value of heating units of the previous printing head, and Step 48 is executed, otherwise Step 47 is executed.

Step 47: setting printing strobe time according to the average resistance value of the heating units of the printing head.

When the average resistance value of the heating units of the currently mounted printing head of the printer is unequal to the preset resistance value $R_0$, which is stored in the FLASH memory, of the heating units, it is determined that the average resistance value of the heating units of the currently mounted printing head is changed compared with the average resistance value of the heating units of the previous printing head, and the controller stores the average resistance value of the heating units of the currently mounted printing head in the FLASH memory as the preset resistance value of the heating units, simultaneously calculates the printing strobe time according to the average resistance value of the heating units of the currently mounted printing head, and sets the printing strobe time according to a calculation result.

Step 48: returning the resolution of the currently mounted printing head to the printing request device.

The controller controls a communication interface to return the resolution of the currently mounted printing head to the printing request device.

In the flow of the method in the embodiment, the controller judges whether the resolution of the currently mounted printing head is equal to the preset resolution $Res_0$, which is stored in the FLASH memory, of the printing head or not, and sets the printer parameter according to the resolution of the currently mounted printing head when the resolution of the currently mounted printing head is unequal to the preset resolution $Res_0$, which is stored in the FLASH memory, of the printing head; meanwhile, the controller judges whether the average resistance value of the heating units of the currently mounted printing head is equal to the preset resistance value $R_0$, which is stored in the FLASH memory, of the heating units or not, and sets the printing strobe time according to the average resistance value of the heating units of the currently mounted printing head when the average resistance value of the heating units of the currently mounted printing head is unequal to the preset resistance value $R_0$, which is stored in the FLASH memory, of the heating units; and meanwhile, the controller controls the communication interface to return the resolution of the currently mounted printing head to the printing request device, and then the printing request device regulates transmitted printing data according to the resolution, which is returned by the printer, of the printing head. For example, for a printer with an effective printing width of 80 mm, data of an image is transmitted to the printer, a width of the transmitted image can maximally be 640 pixels only when the resolution of the mounted printing head is 203 dpi, while the width of the transmitted image can maximally be 945 pixels when the resolution of the mounted printing head is 300 dpi.

A user can transmits the control command of detecting the resolution of the printing head to the printer through the printing request device every time when the printing head of the printer is replaced, and the printer executes the flow of the method after receiving the control command of detecting the resolution of the printing head from the printing request device, and is not required to execute flows of detecting the resolution of the printing head and the resistance value of the heating units under the condition that the printing head is not replaced; therefore, by the method in the embodiment, the working efficiency of the printer can be improved.

Figure 5:
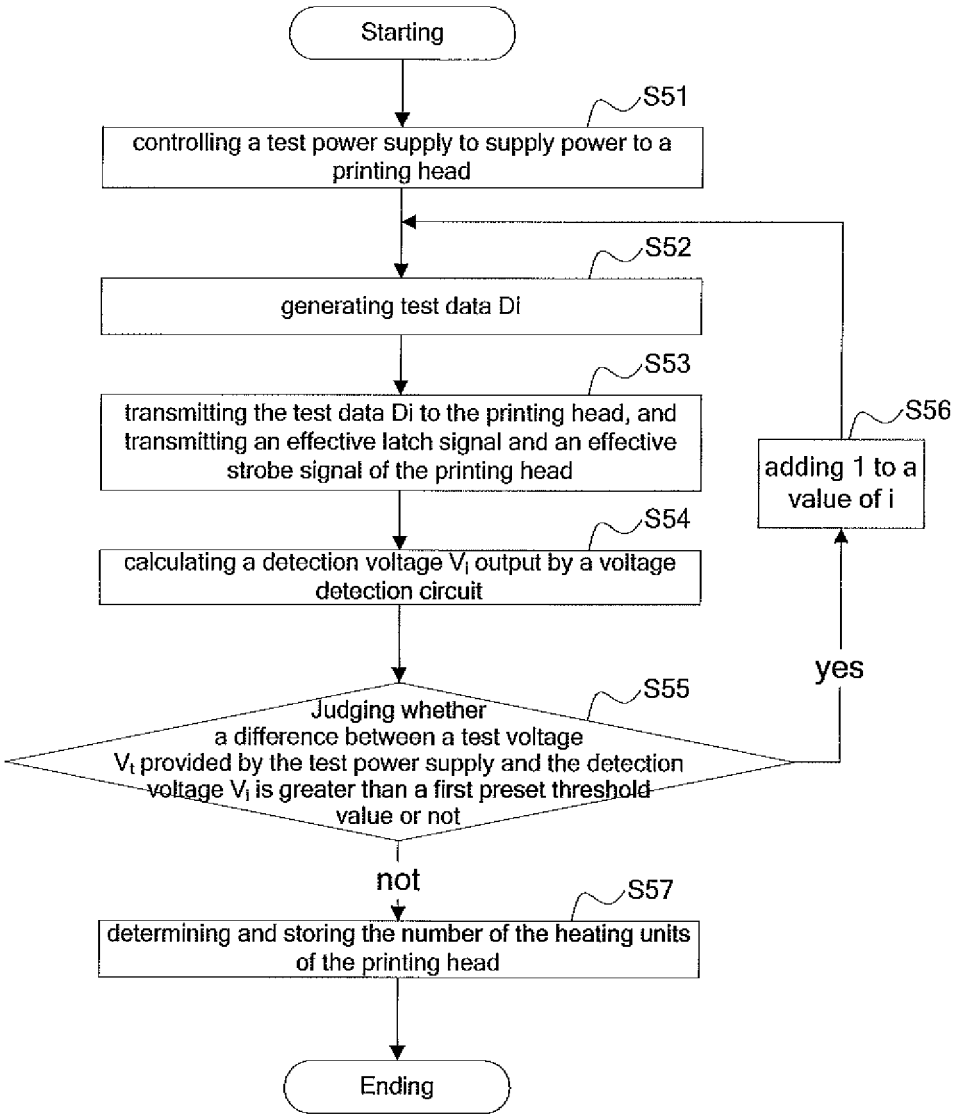
FIG. 5 is a flowchart of a method for detecting heating units of a printing head according to a first embodiment of the disclosure.

FIG. 5 is a flowchart of a method for detecting heating units of a printing head according to a first embodiment of the disclosure, and the method includes the following steps:

Step 51: controlling a test power supply to supply power to the printing head.

A controller outputs a related control signal to make a switch S of a working power supply in an off state, so that a working voltage $V_0$ provided by the working power supply cannot at on the heating units of the printing head, and a test voltage $V_t$ provided by the test power supply acts on a reference resistance Rref and the heating units of the printing head, that is, the test power supply supplies power to the printing head.

Step 52: generating test data Di.

Figures 9, 10:
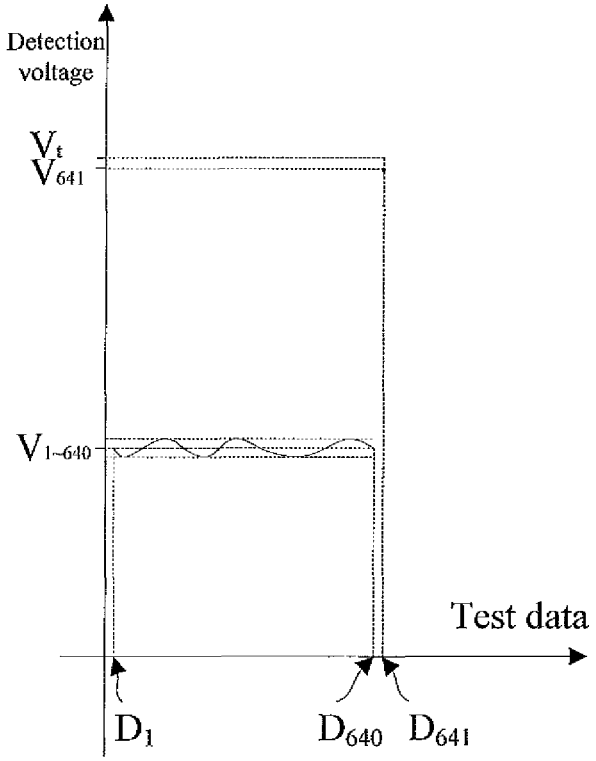
FIG. 9 is a diagram of test data of a printing head according to an embodiment of the disclosure.
FIG. 10 is a diagram of a detection voltage and test data according to an embodiment of the disclosure.

A test data generator generates the test data Di. Wherein, i is a serial number, and is a positive integer valued from 1~j+1, and an initial value of i is 1; j is a maximum value of the number of the heating units, that is, j is the number, which is acquired from a FLASH memory, of the heating units of the printing head with a maximum resolution supported by the printer; and the test data Di consists of j+1-bit binary data, wherein a value of the (j+2−i)th bit of Di is "1", and values of the other bits are "0". FIG. 9 is a diagram of test data of a printing head according to an embodiment of the disclosure, and as shown in FIG. 9, a value of the (j+1)th bit of test data D1 is "1", a value of the jth bit of test data D2 is "1", a value of the (j−1)th bit of test data D3 is "1", . . . , a value of the second bit of test data Dj is "1", and a value of the first bit of test data D(j+1) is "1".

Step 53: transmitting the test data Di to the printing head, and transmitting an effective latch signal and an effective strobe signal of the printing head.

The controller transmits the test data Di to a printing head driver, a shift register of the printing head driver sequentially receives and stores the bits of the test data Di under the synchronization of a clock signal CLK, the controller transmits the effective latch signal LATCH after all the bits of the test data Di are transmitted, a latch of the printing head driver latches the bits, which are stored in the shift register, of the test data Di to the corresponding heating units of the printing head after receiving the effective latch signal LATCH, the controller transmits an effective strobe signal STB at a set time interval after the effective latch signal LATCH is transmitted, and the heating units of the printing head are in a power-on state or a power-off state according to whether the corresponding bits transmitted by the shift register are effective values (such as binary "1") or ineffective values (such as binary "0") when the strobe signal STB received by the printing head driver is changed from an ineffective state (such as high level) to effective state (such as low level).

A storage width of the shift register is M, a value of M is equal to the number of the heating units of the printing head, the number of the heating units of the printing head with the maximum resolution supported by the printer is j, and a length of the test data Di is j+1, so that the length of the test data Di is greater than the storage width M of the shift register, and when a length of data received by the shift register is greater than the storage width M of the shift register, the shift register only reserves the last M bits, and the previously received bits are removed from the shift register, that is, the first (j+1−M) bits received by the shift register are removed from the shift register. When the bits with the value of "1" in the test data Di are located from 1~(j+1−M), the bits with the value of "1" in Di are removed from the shift register, and the values of the bits which are stored in the shift register and transmitted to all the heating units of the printing head are "0", so that all the heating units of the printing head are in the power-off state after the printing head driver receives the effective strobe signal; and when the bits with the value of "1" in the test data Di are located from (j+2−M)~(j+1), the bits with the value of "1" in Di are reserved in the shift register, and the bits which are stored in the shift register and transmitted to all the heating units of the printing head include one bit with the value of "1", so that one of all the heating units of the printing head, i.e. the heating unit corresponding to the bit with the value of "1" in the test data Di, is in the power-on state after the printing head driver receives the effective strobe signal.

The test power supply supplies power to the printing head when the heating units are detected, so that the test voltage $V_t$ provided by the test power supply acts on a reference resistance Rref and the heating units of the printing head, a value of $V_t$ is lower, 3.3V, for example, less heat is generated when the heating units are in the power-on state, and printing dots cannot be formed on a printing medium.

Step 54: calculating a detection voltage $V_i$ output by a voltage detection circuit.

The controller calculates the detection voltage $V_i$ output by the voltage detection circuit after transmitting the test data Di to the printing head and transmitting the effective latch signal and the effective strobe signal of the printing head, as shown in FIG. 7, that is, the controller calculates a voltage of a test point T in the voltage detection circuit; and a part of the test voltage $V_t$ provided by the test power supply acts on the reference resistance Rref, and the other part of the test voltage $V_t$ acts on the heating units of the printing head, that is, the reference resistance Rref and the heating units of the printing head divide the test voltage $V_t$, so that the voltage of the test point T, i.e. the detection voltage $V_i$ output by the voltage detection circuit, is $V_t$*(Rhd/(Rref+Rhd)) after the test data Di is transmitted, wherein Rhd is a resistance value of heating units of the printing head.

Step 55: judging whether a difference between the test voltage $V_t$ provided by the test power supply and the detection voltage $V_i$ is greater than a first preset threshold value or not.

After the controller transmits the test data Di to the printing head, and transmits the effective latch signal and the effective strobe signal of the printing head, when one heating unit of the printing head is in the power-on state, if the serial number of the heating unit in the power-on state is i, that is, if the ith heating unit is in the power-on state, Rhd=$R_i$, wherein $R_i$ is the resistance value of the ith heating unit, so that $V_i=V_t*R_i/(Rref+R_i)$; when all the heating units of the printing head are in the power-off state, switches of all the heating units are in an off state, and Rhd is infinitely great, so that $V_i$ is approximately equal to $V_t$; the controller compares the detection voltage $V_i$ output by the voltage detection circuit with the test voltage $V_t$ provided by the test power supply, judges whether the difference between the detection voltage $V_i$ output by the voltage detection circuit and the detection voltage $V_i$, i.e. a value of $(V_t-V_i)$, is greater than the preset threshold value or not, determines that one heating unit of the printing head is in the power-on state after the test data Di is transmitted if the value of $(V_t-V_i)$ is greater than the first preset threshold value, and executes Step 56; and if the value of $(V_t-V_i)$ is not greater than the first preset threshold value, the controller determines that all the heating units of the printing head are in the power-off state after the data Di is transmitted, and executes Step 57.

Step 56: adding 1 to the value of i.

The controller adds 1 to the value of i on the basis of a current value, and then re-executes Step 52.

Step 57: determining and storing the number of the heating units of the printing head.

When the value of $(V_t-V_i)$ is not greater than the first preset threshold value, the controller determines that all the heating units of the printing head are in the power-off state after the test data Di is transmitted; when the value of $(V_t-V_{i-1})$ is greater than the first preset threshold value, that is, one of all the heating units of the printing head is in the power-on state after the controller transmitting the test data D(i−1), so that the controller determines that the bits with the value of "1" in the test data are reserved in the shift register when the test data Di is transmitted; and when the test data D1~D(i−1) is transmitted, the bits with the value of "1" in the test data are reserved in the shift register, and the heating units of the printing head are sequentially gated, so that the controller determines that the storage width M of the shift register of the printing head river is i−1. The value of the storage width M of the shift register is equal to the number of the heating units of the printing head, and (i−1) heating units of the printing head are sequentially gated in a process of transmitting the data D1~D(i−1), so that the tested printing head totally includes (i−1) heating units, that is, the number N of the heating units of the currently mounted printing head of the printer is i−1, and the controller stores the value of N in a RAM.

FIG. 10 is a diagram of each detection voltage $V_i$ output by the voltage detection circuit after the controller transmits the test data Di when the number of the heating units of the printing head including 640 heating units, as shown in FIG. 7, is detected, and as shown in FIG. 10, the voltage detection circuit outputs totally 641 detection voltages $V_1, V_2, \ldots, V_{640}$ and $V_{641}$, wherein differences between the test voltage $V_t$ and the detection voltages $V_1 \sim V_{640}$ are all greater than the first preset threshold value, a difference between the test voltage $V_t$ and the detection voltage $V_{641}$ is not greater than the first preset threshold value, and a value of the detection voltage suddenly changes at $V_{641}$, so that the number N of the heating units of the printing head is 641−1=640.

Figure 6:
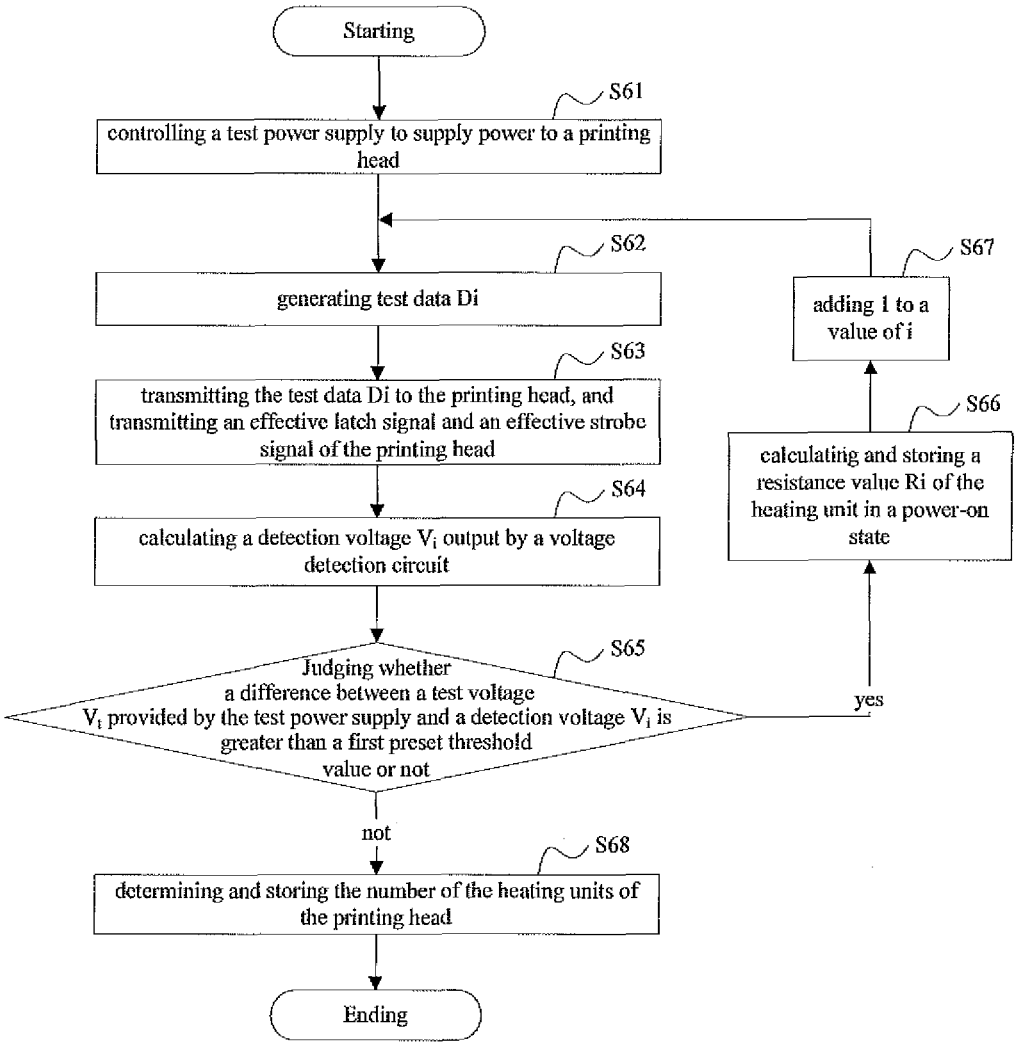
FIG. 6 is a flowchart of a method for detecting heating units of a printing head according to a second embodiment of the disclosure.

FIG. 6 is a flowchart of a method for detecting heating units of a printing head according to a second embodiment of the disclosure, and the method includes the following steps:

Step 61 to Step 64: executing operation the same as that in Step 51 to Step 54.

Step 65: judging whether a difference between a test voltage $V_t$ provided by a test power supply and a detection voltage $V_i$ is greater than a first preset threshold value or not.

A controller compares the detection voltage $V_i$ output by the voltage detection circuit with the test voltage $V_t$ provided by the test power supply, and judges whether the difference between the test voltage $V_t$ provided by the test power supply and the detection voltage $V_i$, i.e. a value of $(V_t-V_i)$, is greater than the first preset threshold value or not, and when the value of $(V_t-V_i)$ is greater than the first preset threshold value, the controller determines that one heating unit of the printing head is in a power-on state after test data Di is transmitted, and Step 66 is executed; and when the value of $(V_t-V_i)$ is not greater than the first preset threshold value, the controller determines that all the heating units of the printing head are in a power-off state after the data Di is transmitted, and Step 68 is executed.

Step 66: calculating and storing a resistance value $R_i$ of the heating unit in the power-on state.

When the value of $(V_t-V_i)$ is greater than the first preset threshold value, the controller determines that one heating unit of the printing head is in the power-on state after the test data Di is transmitted, and calculates the resistance value $R_i$ of the heating unit in the power-on state; and $V_i=V_t*R_i/(Rref+R_i)$, so that $R_i=V_i*Rref/(V_t-V_i)$, and the controller stores the resistance value $R_i$ in a RAM.

Step 67: adding 1 to a value of i.

The controller adds 1 to the value of i on the basis of a current value, and then re-executes Step 62.

Step 68: executing operation the same as that in Step 57.

According to the printer and the method for controlling the same provided by the embodiment of the disclosure, the resolution of the printing head of the printer can be automatically and accurately detected, the resistance value of the heating units of the printing head can be detected, and the related printer parameter can be automatically set according to the resolution of the printing head and the resistance value of the heating units of the printing head, so that the operation of manually setting the resolution of the printing head by the user is eliminated, and the problem of abnormal printed content or printing head damage caused by an error in an manual operation process of the user is solved.

Correspondingly to the method for controlling the printer provided by the embodiment of the disclosure, the embodiment of the disclosure also provides a device for controlling the printer. It should be noted that the method for controlling the printer in the embodiment of the disclosure can be executed by the device for controlling the printer provided by the embodiment of the disclosure, and the device for controlling the printer in the embodiment of the disclosure can also be configured to execute the method for controlling the printer provided by the embodiment of the disclosure.

Figure 11:
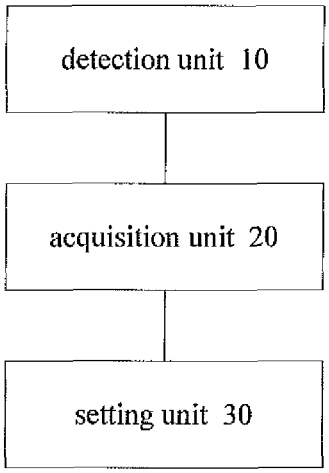
FIG. 11 is a diagram of a device for controlling a printer according to an embodiment of the disclosure.

FIG. 11 is a diagram of a device for controlling a printer according to an embodiment of the disclosure. As shown in FIG. 11, the device for controlling the printer includes a detection unit 10, an acquisition unit 20 and a setting unit 30.

The detection unit 10 is configured to detect the number of heating units of a currently mounted printing head.

The acquisition unit 20 is configured to acquire a resolution, corresponding to the detected number of the heating units of the printing head, of the printing head.

The setting unit 30 is configured to set a printer parameter according to the acquired resolution of the printing head.

Figure 12A:
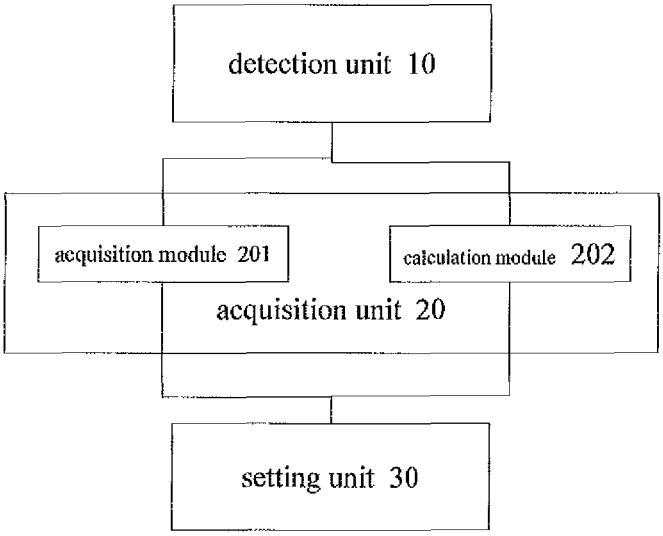
FIG. 12*a* is a diagram of a device for controlling a printer according to a first preferred embodiment of the disclosure.

FIG. 12*a* is a diagram of a device for controlling a printer according to a first preferred embodiment of the disclosure. The device in the embodiment can be taken as a preferred implementation mode of the device shown in FIG. 11, and in the embodiment, the device for controlling the printer includes a detection unit 10, an acquisition unit 30 and a setting unit 30, and functions of the detection unit 10, the acquisition unit 20 and the setting unit 30 are the same as those in the abovementioned embodiment, and will not be repeated here, wherein the acquisition unit 20 includes an acquisition module 201 or a calculation module 202.

The acquisition module 201 is configured to acquire the resolution, corresponding to the detected number of the heating units of the printing head, of the printing head according to a pre-stored corresponding relationship between the number of the heating units of the printing head and the resolution of the printing head.

The calculation module 202 is configured to calculate the resolution, corresponding to the detected number of the heating units of the printing head, of the printing head according to the detected number of the heating units of the printing head and an effective printing width.

Figure 12B:
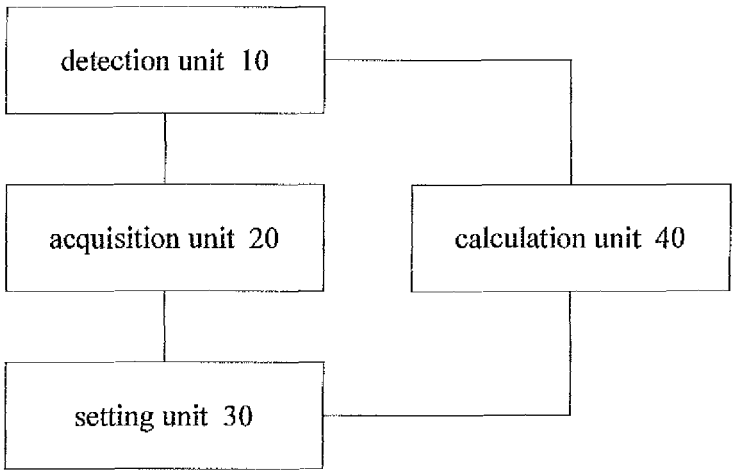
FIG. 12*b* is a diagram of a device for controlling a printer according to a second preferred embodiment of the disclosure.

FIG. 12*b* is a diagram of a device for controlling a printer according to a second preferred embodiment of the disclosure. The device in the embodiment can be taken as a preferred implementation mode of the device shown in FIG. 11, and in the embodiment, the device for controlling the printer includes a detection unit 10, an acquisition module 20 and a setting unit 30, and functions of the detection unit 10, the acquisition unit 20 and the setting unit 30 are the same as those in the abovementioned embodiment, and will not be repeated here, wherein the detection unit 10 is further configured to detect a resistance value of each heating unit. The device further includes: a calculation unit 40, configured to calculate an average resistance value of all heating units of a currently mounted printing head, wherein the setting unit 30 is configured to set a printer parameter according to a resolution of the printing head and the average resistance value.

Obviously, those skilled in the art should know that each module or step of the disclosure can be implemented by a universal computing device, and the modules or steps can be concentrated on a single computing device or distributed on a network formed by a plurality of computing devices, and can optionally be implemented by programmable codes executable for the computing devices, so that the modules or steps can be stored in a storage device for execution with the computing devices, or can form each integrated circuit module, or multiple modules or steps therein can form a single integrated circuit module for implementation. As a consequence, the disclosure is not limited to any specific hardware and software combination.

The above is only the preferred embodiment of the disclosure and not intended to limit the disclosure, and for those skilled in the art, the disclosure can have various modifications and variations. Any modifications, equivalent replacements, improvements and the like within the spirit and principle of the disclosure shall fall within the scope of protection of the disclosure.

What is claimed is:

1. A method for controlling a printer, comprising:

detecting number of heating units of a currently mounted printing head;

acquiring a resolution, corresponding to the detected number of the heating units of the printing head; and setting a printer parameter according to the acquired resolution of the printing head, wherein detecting the number of the heating units of the currently mounted printing head comprises:

controlling a test power supply to supply power to the printing head to make a test voltage $V_t$ act on a reference resistance Rref and the heating units, wherein the reference resistance Rref is configured to divide the test voltage $V_t$;

generating test data Di, wherein i is a positive integer between 1 and j+1, an initial value of i is 1, j is a number of the heating units of the printing head with a maximum resolution supported by the printer, the test data Di consists of j+1-bit binary data, a value of the (j+2−i)th bit of the test data Di is "1", and values of the other bits are all "0";

transmitting the test data Di to the printing head, and transmitting an effective latch signal and an effective strobe signal of the printing head, wherein a shift register of a printing head driver of the printing head sequentially receives and stores the bits of the test data Di under the synchronization of a clock signal CLK;

calculating a detection voltage $V_i$ output by a voltage detection circuit according to $V_i=V_t*(Rhd/(Rref+Rhd))$, wherein Rhd is the resistance value of heating units of the printing head, and Rref is a resistance value of the reference resistance of the voltage detection circuit;

judging whether a difference between the test voltage $V_t$ and the detection voltage $V_i$ is greater than a preset threshold value or not, adding 1 to a value of i when the difference between the test voltage $V_t$ and the detection voltage $V_i$ is greater than the preset threshold value and continuing transmitting the test data Di to the printing head; and determining the number of the heating units of the printing head to be N=i−1 when the difference between the test voltage $V_t$ and the detection voltage $V_i$ is determined not to be greater than the preset threshold value.

2. The method according to claim 1, wherein acquiring the resolution, corresponding to the number of the heating units, of the printing head comprises:

acquiring the resolution, corresponding to the detected number of the heating units, of the printing head according to a pre-stored corresponding relationship between the number of the heating units and the resolution of the printing head, or calculating the resolution, corresponding to the detected number of the heating units, of the printing head according to the detected number of the heating units and an effective printing width.

3. The method according to claim 1, before setting the printer parameter according to the acquired resolution of the printing head, further comprising: detecting a resistance value of each heating unit of the printing head; and calculating an average resistance value of all the heating units of the printing head, setting the printer parameter according to the acquired resolution of the printing head comprises: setting the printer parameter according to the resolution of the printing head and the average resistance value.

4. The method according to claim 3, wherein setting the printer parameter according to the resolution of the printing head and the average resistance value comprises:

judging whether the average resistance value is equal to a preset resistance value of the heating units or not, wherein setting printing strobe time according to the average resistance value when the average resistance value is determined to be unequal to the preset resistance value of the heating units.

5. The method according to claim 1, before setting the printer parameter according to the acquired resolution of the printing head, further comprising:

judging whether the resolution of the currently mounted printing head is equal to a preset resolution of the printing head or not, wherein setting the printer parameter according to the acquired resolution of the printing head when the resolution of the currently mounted printing head is determined to be unequal to the preset resolution of the printing head.

6. The method according to claim 1, when the difference between the test voltage $V_t$ and the detection voltage $V_i$ is determined to be greater than the first preset threshold value, further comprising:

calculating and storing the resistance value $R_i$ of the heating units of the printing head in a power-on state, wherein an average value of the resistance value $R_i$ of all the heating units of the printing head is used as the average resistance value of the heating units of the printing head.

7. A device for controlling a printer, comprising:

a detection unit, configured to detect number of heating units of a currently mounted printing head, wherein detect number of heating units of a currently mounted printing head comprises:

control a test power supply to supply power to the printing head to make a test voltage $V_t$ act on a reference resistance Rref and the heating units, wherein the reference resistance Rref is configured to divide the test voltage $V_t$;

generate test data Di, wherein i is a positive integer between 1 and j+1, an initial value of i is 1, j is a number of the heating units of the printing head with a maximum resolution supported by the printer, the test data Di consists of j+1-bit binary data, a value of the (j+2−i)th bit of the test data Di is "1", and values of the other bits are all "0";

transmit the test data Di to the printing head, and transmitting an effective latch signal and an effective strobe signal of the printing head, wherein a shift register of a printing head driver of the printing head sequentially receives and stores the bits of the test data Di under the synchronization of a clock signal CLK;

calculate a detection voltage $V_i$ output by a voltage detection circuit according to $V_i=V_t*(Rhd/(Rref+Rhd))$, wherein Rhd is the resistance value of heating units of the printing head, and Rref is a resistance value of the reference resistance of the voltage detection circuit;

judge whether a difference between the test voltage $V_t$ and the detection voltage $V_i$ is greater than a preset threshold value or not, adding 1 to a value of i when the difference between the test voltage $V_t$ and the detection voltage $V_i$ is greater than the preset threshold value, and continuing transmitting the test data Di to the printing head; and determine the number of the heating units of the printing head to be N=i−1 when the difference between the test voltage $V_t$ and the detection voltage $V_i$ is determined not to be greater than the preset threshold value;

an acquisition unit, configured to acquire a resolution, corresponding to the detected number of the heating units of the printing head, of the printing head; and a setting unit, configured to set a printer parameter according to the acquired resolution of the printing head.

8. The device according to claim 7, wherein the acquisition unit comprises:

an acquisition module, configured to acquire the resolution, corresponding to the detected number of the heating units of the printing head, of the printing head according to a pre-stored corresponding relationship between the number of the heating units of the printing head and the resolution of the printing head, or a calculation module, configured to calculate the resolution, corresponding to the detected number of the heating units of the printing head, of the printing head according to the detected number of the heating units of the printing head and an effective printing width.

9. The device according to claim 7, wherein the detection unit is further configured to detect a resistance value of each heating unit, and the device further comprises:

a calculation unit, configured to calculate an average resistance value of all the heating units of the currently mounted printing head, wherein the setting unit is configured to set the printer parameter according to the resolution of the printing head and the average resistance value.

* * * * *

UNITED STATES PATENT AND TRADEMARK OFFICE

CERTIFICATE OF CORRECTION

PATENT NO. : 9,333,781 B2
APPLICATION NO. : 14/435767
DATED : May 10, 2016
INVENTOR(S) : Bo Qu et al.

It is certified that error appears in the above-identified patent and that said Letters Patent is hereby corrected as shown below:

Title Page

Item (73) Assignee

Change "Shandong New Beijang Information Technology Co., Ltd." to "Shandong New Beiyang Information Technology Co., Ltd."

Signed and Sealed this
Twenty-third Day of August, 2016

Michelle K. Lee

Michelle K. Lee
*Director of the United States Patent and Trademark Office*